US009365037B2

(12) United States Patent
Fukaya et al.

(10) Patent No.: US 9,365,037 B2
(45) Date of Patent: Jun. 14, 2016

(54) LIQUID DISCHARGE APPARATUS AND MANUFACTURING METHOD THEREOF

(71) Applicant: CANON KABUSHIKI KAISHA, Tokyo (JP)

(72) Inventors: Youichi Fukaya, Tokyo (JP); Hidehiko Fujimura, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/654,908

(22) PCT Filed: Jan. 28, 2014

(86) PCT No.: PCT/JP2014/052372
§ 371 (c)(1),
(2) Date: Jun. 23, 2015

(87) PCT Pub. No.: WO2014/119773
PCT Pub. Date: Aug. 7, 2014

(65) Prior Publication Data

US 2015/0343782 A1 Dec. 3, 2015

(30) Foreign Application Priority Data

Feb. 1, 2013 (JP) ..... 2013-018081

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14209* (2013.01); *B41J 2/1607* (2013.01); *B41J 2/1623* (2013.01); *B41J 2202/11* (2013.01); *Y10T 156/1064* (2015.01)

(58) Field of Classification Search
CPC ..... B41J 2/14201; B41J 2/14209; B41J 2/14032; B41J 2002/14241; B41J 2002/14258
See application file for complete search history.

(56) References Cited

U.S. PATENT DOCUMENTS 4,827,287 A * 5/1989 Braun ..... B41J 2/025 205/134
4,879,568 A 11/1989 Bartky et al.
(Continued)

FOREIGN PATENT DOCUMENTS

| | | | |
|---|---|---|---|
| EP | 0484983 | A2 | 5/1992 |
| JP | 5-88944 | U | 12/1993 |
| JP | 6-6375 | B2 | 1/1994 |
| JP | 9-39230 | A | 2/1997 |

OTHER PUBLICATIONS

International Search Report and Written Opinion in PCT/JP2014/052372, dated Apr. 15, 2014.
(Continued)

*Primary Examiner* — Geoffrey Mruk
(74) *Attorney, Agent, or Firm* — Fitzpatrick, Cella, Harper & Scinto

(57) ABSTRACT

To reduce a liquid discharge amount by vibrating meniscuses at high acceleration with displacement of partitions, a plurality of partitions, each formed of a piezoelectric material, are provided to thereby form a plurality of pressure chambers. Each of electrode pairs for shear-deforming each partition is arranged on both sides of a corresponding one of the partitions. A nozzle plate having nozzles each connected to one of the pressure chambers is arranged on the side of a first end of the pressure chambers. Each pressure chamber is formed such that the width of the pressure chamber becomes long as it approaches, from the first end, a second end on the opposite side.

7 Claims, 6 Drawing Sheets

(56) References Cited

U.S. PATENT DOCUMENTS

| | | | |
|---|---|---|---|
| 4,887,100 | A | 12/1989 | Michaelis et al. |
| 5,028,936 | A | 7/1991 | Bartky et al. |
| RE36,667 | E | 4/2000 | Michaelis et al. |
| 6,676,238 | B2 | 1/2004 | Fujimura et al. |
| 2014/0217198 | A1 | 8/2014 | Ochi et al. |

OTHER PUBLICATIONS

International Preliminary Report on Patentability and Written Opinion in International Application No. PCT/JP2014/052372, mailed Aug. 13, 2015.

* cited by examiner

LIQUID DISCHARGE APPARATUS AND MANUFACTURING METHOD THEREOF

TECHNICAL FIELD

The present invention relates to a liquid discharge apparatus in which pressure chambers partitioned by partitions each composed of a piezoelectric material are formed, and a manufacturing method of the liquid discharge apparatus.

BACKGROUND ART

As a liquid discharge head serving as a liquid discharge apparatus, a type of head of changing pressure of ink in a pressure chamber, causing a flow in the ink, and discharging the ink from a nozzle, thereby discharging droplets has spread. Particularly, a drop-on-demand head has most spread in general. Incidentally, there are roughly two methods of applying pressure to ink. Namely, one is the method of changing the pressure of the ink by changing the pressure in a pressure chamber in response to a driving signal supplied to a piezoelectric material, and the other is the method of applying the pressure to the ink by generating air bubbles in the pressure chamber in response to a driving signal supplied to a resistor.

The liquid discharge head in which the piezoelectric material is used has adopted various kinds of methods. In these methods, a shear mode method which can be easily achieved comparatively by machining a bulk piezoelectric material has been often adopted. In the shear mode method, the piezoelectric material which has been polarized is shear-deformed by application of an electric field in its orthogonal direction. Here, the piezoelectric material to be deformed serves as a partition which is formed by processing ink grooves and the like on the polarized bulk piezoelectric material by using a dicing blade. An electrode pair (i.e., a pair of electrodes) is formed on both the sides of each partition to drive the piezoelectric material, and the liquid discharge head is finally constituted by forming a nozzle plate having nozzles thereon and an ink supply system (Patent Literature 1).

Besides, the liquid discharge head adopting the shear mode method has an advantage that restrictions on inks are relatively few and it is thus possible to selectively apply inks of wide-range materials to a recording medium. From this viewpoint, in recent years, an attempt to utilize the liquid discharge head for industrial applications such as color filter manufacturing, wiring patterning and the like has been often made. Moreover, to achieve further high-definition patterning, a smaller volumer per ink droplet to be discharged by the liquid discharge head has been required.

CITATION LISTS

Patent Literature

PTL 1: Japanese Patent Application Publication No. H06-6375

SUMMARY OF INVENTION

Technical Problem

To obtain a minute liquid discharge amount of the liquid discharge head, it is necessary to make minute droplets by minutely tearing or nipping a liquid column discharged from the nozzle. Thus, it is necessary to enlarge vibration acceleration of meniscuses of the liquid in the nozzle. To achieve this, it is necessary to transfer, in a moment, the pressure generated by the displacement of the partitions to the meniscuses of the liquid. On such a premise, when the liquid discharge head adopting the shear mode method is used, a displacement amount of the partition serving as an actuator is generally small. For this reason, the pressure chamber is made long toward the nozzle, so as to secure a displacement volume amount of the pressure chamber.

In case of pressurizing the liquid in the pressure chamber like this, the center of pressure of the liquid is located substantially at the central portion of the pressure chamber in the longitudinal direction. That is, since the pressure chamber is prolonged in the longitudinal direction, the distance from the meniscus position to the center of pressure of the liquid is also prolonged, and thus there is a problem that responsiveness is deteriorated.

Moreover, in the liquid discharge head adopting the shear mode method, the cross-section area of the cross section along the face perpendicular to the longitudinal direction of the pressure chamber is made small so as to be able to generate pressure even by a small displacement amount of the piezoelectric material. This contrarily implies that flow channel resistance in the case where the liquid flows in the longitudinal direction is large. That is, in the liquid discharge head adopting the shear mode method, flowing speed of the liquid flowing into or from the pressure chamber is restricted. In addition, since the center of pressure is far from the meniscus position, it is impossible to transfer, in a moment, the pressure generated by displacement of the piezoelectric material to the meniscus.

In consideration of the above problems, the present invention aims to reduce the liquid discharge amount by vibrating at high acceleration the meniscuses with the displacement of partitions.

Solution to Problem

A liquid discharge apparatus according to the present invention is characterized by comprising: a plurality of pressure chambers formed by a plurality of partitions each composed of a piezoelectric material; a plurality of electrode pairs each of which is arranged on both sides of each partition and shear-deforms each partition; and a nozzle member which is arranged on a side of a first end of each pressure chamber and on which each nozzle connected to each pressure chamber has been formed, wherein each pressure chamber is formed such that a relatively shorter one of a height and a width of the pressure chamber at the first end becomes long as it approaches, from the first end, a second end on the opposite side.

Further features of the present invention will become apparent from the following description of an exemplary embodiment with reference to the attached drawings.

DESCRIPTION OF EMBODIMENT

Figure 1:
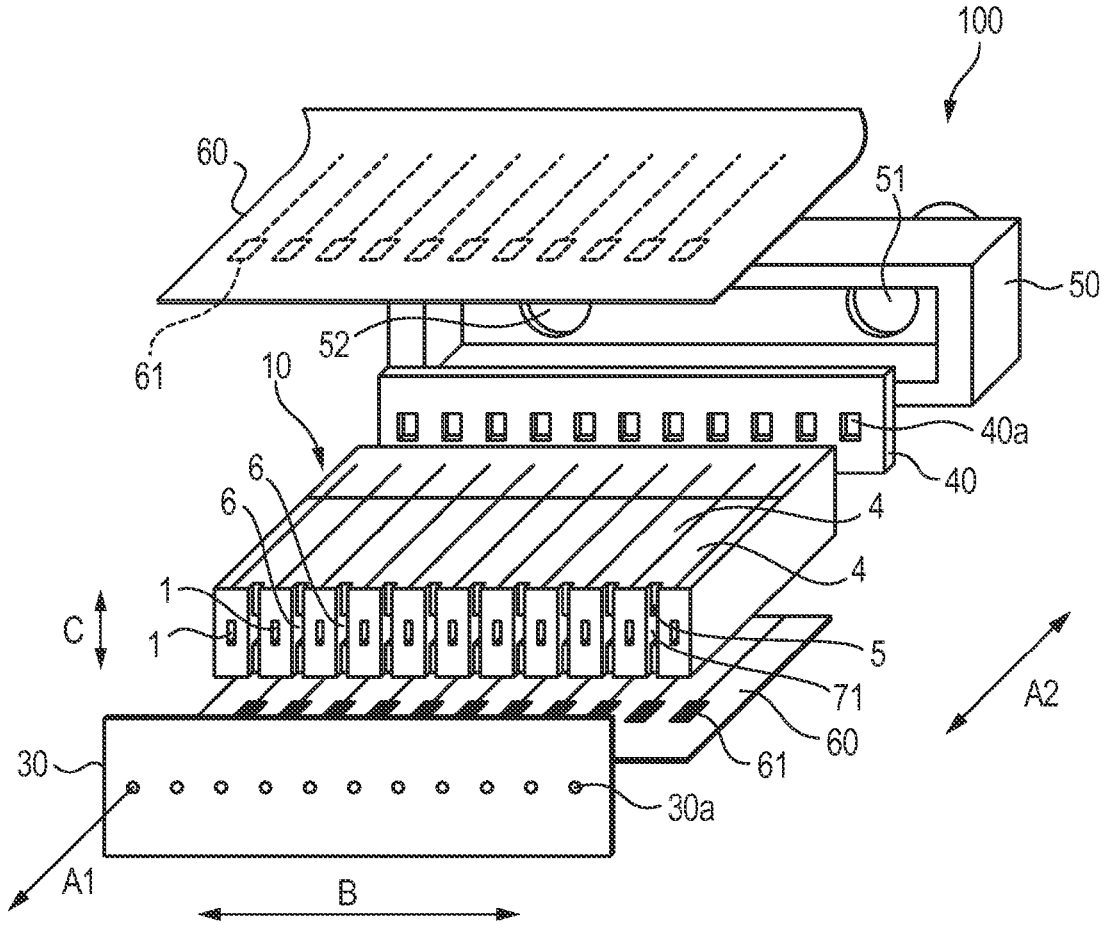
FIG. 1 is an exploded perspective diagram illustrating an inkjet head as an example of a liquid discharge head serving as a liquid discharge apparatus according to the present embodiment.

Hereinafter, an exemplary embodiment of the present invention will be described in detail with reference to the attached drawings. FIG. 1 is an exploded perspective diagram illustrating an inkjet head as an example of a liquid discharge head serving as a liquid discharge apparatus according to the present embodiment. An inkjet head 100 illustrated in FIG. 1 has a discharge unit 10, where a plurality of pressure chambers 1 provided in parallel in one row in the width direction B orthogonal to the longitudinal direction A2 parallel with the liquid discharge direction A1 are formed. A nozzle plate 30 serving as a nozzle member, where respective nozzles 30*a* are formed corresponding to the respective pressure chambers 1, is arranged at the liquid discharge side face (front face) of the discharge unit 10. The discharge unit 10 and the nozzle plate 30 are aligned and bonded to each other such that the positions of the pressure chambers 1 coincide with the positions of the nozzles 30*a* (that is, the pressure chambers 1 communicate with the nozzles 30*a*). Accordingly, each of the nozzles 30*a* is connected with each of the pressure chambers 1.

The pressure chambers 1 extend to the liquid supply side face (back face) of the discharge unit 10 along the longitudinal direction A2. A back plate 40 is arranged at the back face of the discharge unit 10. Respective ink supply ports 40*a* are formed at the back plate 40 corresponding to the respective pressure chambers 1. As just described, the discharge unit 10 and the back plate 40 are aligned and bonded to each other such that the positions of the pressure chambers 1 coincide with the positions of the ink supply ports 40*a*. In addition, a manifold 50 serving as a common liquid chamber forming member, which has an ink supply port 51 and an ink recovery port 52 communicated with an ink tank (not illustrated), is bonded to the back plate 40. Further, flexible substrates 60, on which a plurality of signal wirings 61 are formed respectively, are bonded to the both-side faces of the discharge unit 10 in the height direction C orthogonal to the liquid discharge direction A1 (longitudinal direction A2) and the width direction B.

Figure 2:
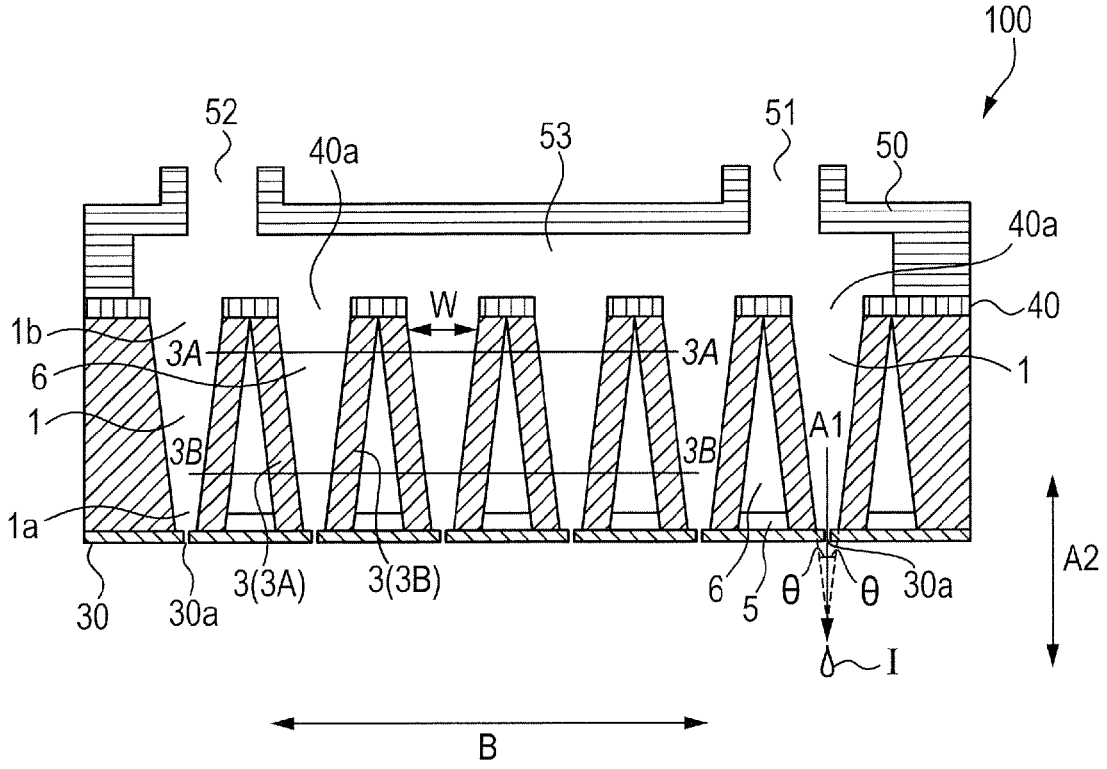
FIG. 2 is a cross-section perspective diagram of ink channels for describing a flow of ink as liquid in the inkjet head.
Figure 3A:
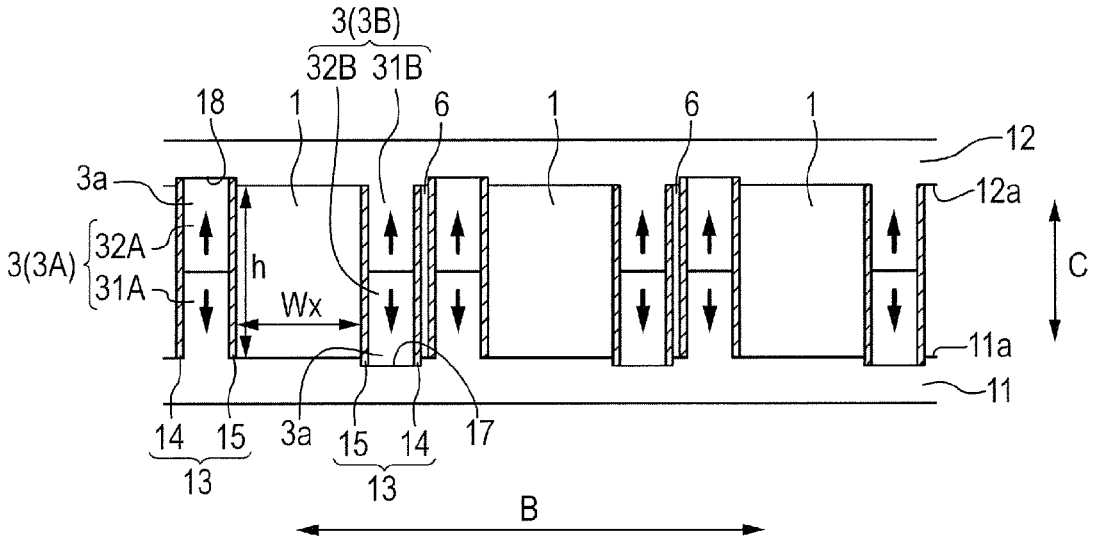
FIGS. 3A and 3B are cross-section diagrams respectively illustrating faces perpendicular to a longitudinal direction of a discharge unit.
Figure 3B:
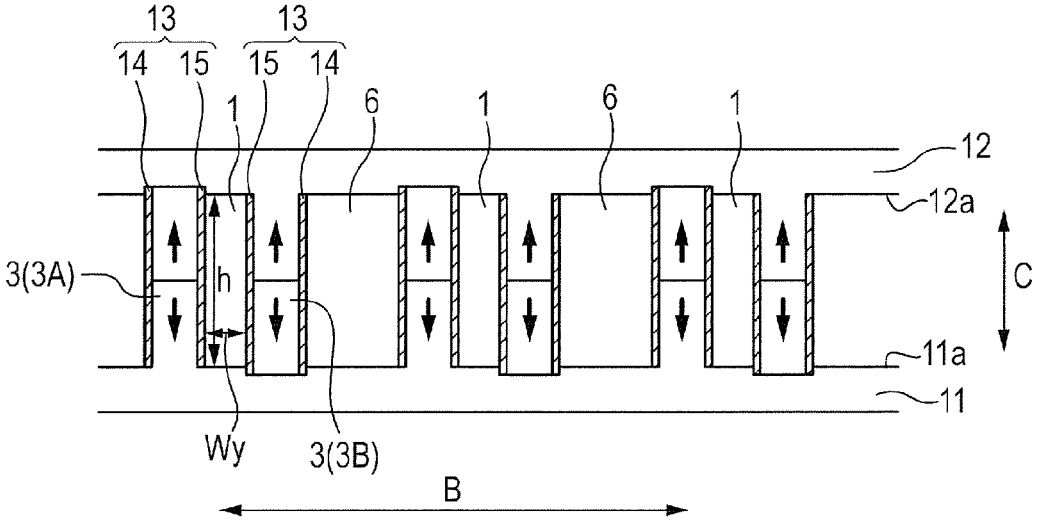

FIG. 2 is a cross-section perspective diagram of ink channels for describing a flow of ink as liquid in the inkjet head 100. FIGS. 3A and 3B are cross-section diagrams respectively illustrating faces perpendicular to the longitudinal direction of the discharge unit 10. More specifically, FIG. 3A is the cross-section diagram along the 3A-3A face relatively close to the back-face side in FIG. 2, and FIG. 3B is the cross-section diagram along the 3B-3B face relatively close to the front-face side in FIG. 2.

As illustrated in FIGS. 3A and 3B, the discharge unit 10 has two substrates 11 and 12 (first substrate 11 and second substrate 12) which face each other and a plurality of partitions 3 provided in parallel with space in the width direction B orthogonal to the height direction C between the first substrate 11 and the second substrate 12. These partitions 3 are formed lengthwise, and the plurality of pressure chambers 1 extended to the longitudinal direction A2 are formed by the plurality of partitions 3. Each of the partitions 3 is composed of a piezoelectric material polarized in the height direction C. Incidentally, in FIGS. 3A and 3B, the height in the height direction C of the each pressure chamber 1 is represented by "h", and the width in the width direction B of the each pressure chamber 1 is represented by "Wx" and "Wy".

The discharge unit 10 has a plurality of electrode pairs (plurality of pairs of electrodes) 13 each of which is arranged at both sides of each of the partitions 3, and by which each of the partitions 3 is shear-deformed. That is, the electrode pairs 13 are respectively provided on the respective partitions 3. More specifically, the electrode pair 13 composed of a signal electrode 14 and a common electrode 15 is provided on both the sides of each partition 3 in the direction orthogonal to the liquid discharge direction A1 (longitudinal direction A2), that is, in the width direction B. The electrode 14 is arranged on the air-chamber side and the electrode 15 is arranged on the pressure-chamber side.

The signal electrode 14 is electrically connected to an extraction electrode 4 through a front electrode 71 formed inside a front groove 5 illustrated in FIG. 1. The common electrode 15 is grounded. An electric field is applied to the partition 3 in the direction (width direction) orthogonal to the polarization direction by a process that the voltage is applied to the electrode pairs 13 and then the partition 3 functions as a piezoelectric device for shear-deforming the partition in the width direction B. More specifically, the potential of the common electrode 15 is set to the ground potential, and the voltage is applied to the signal electrode 14 for the common electrode 15.

As illustrated in FIG. 2, the nozzle plate 30 is arranged on the side of a first end 1*a* in the longitudinal direction A2 corresponding to the liquid discharge side of the pressure chamber 1. On the other hand, the manifold 50 is arranged on the side of a second end 1*b* in the longitudinal direction A2 which is the opposite side for the first end 1*a* corresponding to the liquid supply side of the pressure chamber 1, and a common liquid chamber 53 is formed. Ink I (not illustrated) is supplied to the common liquid chamber 53 from a not-illustrated ink tank through the ink supply port 51. The ink I supplied to the common liquid chamber 53 is filled up into the respective pressure chambers 1 through the ink supply ports 40*a*. Then, the volume of the pressure chamber 1 is varied by a fact that the partition 3 is shear-deformed, whereby the ink (ink droplets) I, which is liquid (droplets), is discharged from the nozzles 30*a*.

As illustrated in FIGS. 3A and 3B, the plurality of partitions 3 are composed of a plurality of first partitions 3A protrusively provided on the one face 11*a* of the first substrate 11 and a plurality of second partitions 3B protrusively provided on the one face 12*a* of the second substrate 12.

A tip 3*a* of the first partition 3A is bonded to the one face 12*a* of the second substrate 12 and also a tip 3*a* of the second partition 3B is bonded to the one face 11*a* of the first substrate 11 such that the first partition 3A and the second partition 3B are alternately provided in parallel with space in the width direction B. Thus, a space is partitioned by the first partition 3A and the second partition 3B which are adjacent to each other, and the pressure chamber 1 is formed.

A first groove 17, which is interdigitated with the tip 3*a* of the second partition 3B, is formed on the one face 11*a* of the first substrate 11. A groove 18, which is interdigitated with the tip 3*a* of the first partition 3A, is formed on the one face 12*a* of the second substrate 12.

The first partition 3A, which protrudes from the one face 11*a* of the first substrate 11, is integrally formed with the first substrate 11 and has a first base-side piezoelectric material 31A polarized in the height direction C. In addition, the first partition 3A, which is bonded to the first base-side piezoelectric material 31A, has a first tip-side piezoelectric material 32A polarized in the direction opposite to the first base-side piezoelectric material 31A.

The second partition 3B, which protrudes from the one face 12*a* of the second substrate 12, is integrally formed with the second substrate 12 and has a second base-side piezoelectric material 31B polarized in the height direction C. In addition, the second partition 3B, which is bonded to the second base-side piezoelectric material 31B, has a second tip-side piezoelectric material 32B polarized in the direction opposite to the second base-side piezoelectric material 31B.

An air chamber 6 is formed between the two pressure chambers 1 and 1, which are adjacent to each other, among the plural pressure chambers 1. The air chamber 6 is not communicated with the nozzle 30*a* and the ink supply port 40*a* but is communicated with the front groove 5 formed on the front face. Therefore, it is structured that the ink, which is liquid, is not filled up into the air chamber 6.

Specifically, the air chamber 6 is formed by the partitioning with the two partitions 3 which form the pressure chamber 1. More specifically, the air chamber 6 is formed by the partitioning with the first partition 3A and the second partition 3B. In the present embodiment, the pressure chambers 1 and the air chambers 6 are alternately formed in the width direction B.

In the present embodiment, although the air chamber 6 is arranged to independently control the adjacent pressure chambers 1, and improve the operation of the partition 3 composed of the piezoelectric material by providing air space, it may not be arranged.

Each of the pressure chambers 1 is formed such that the relatively shorter one of the height and the width of the pressure chamber 1 at the first end 1*a*, i.e., the width of the pressure chamber 1 in the present embodiment, becomes gradually long from the first end 1*a* to the second end 1*b*. In other words, the pressure chamber 1 is formed such that the width thereof becomes wide as it approaches, from the first end 1*a*, the second end 1*b*. That is, each of the pressure chambers 1 is formed such that the width of the pressure chamber 1 at the second end 1*b* is longer than the width of the pressure chamber 1 at the first end 1*a*. In other words, each of the pressure chambers 1 is formed such that the width thereof becomes gradually long from the first end 1*a* toward the second end 1*b*. Further, in other words, the pressure chamber 1 is formed such that the width thereof becomes wide as it approaches the second end 1*b* from the first end 1*a*.

In the present embodiment, the first partition 3A extends from the front face, to which the nozzle plate 30 is attached, to the back face, to which the back plate 40 is attached, illustrated in FIG. 2 along the direction inclined by a predetermined angle θ to the liquid discharge direction A1 (longitudinal direction A2). The second partition 3B, of which the direction is opposite to that of the first partition 3A, extends in the direction inclined by a predetermined angle θ to the liquid discharge direction A1 (longitudinal direction A2). According to this structure, a width Wy on the liquid discharge side of the pressure chamber 1 becomes narrow as compared with a width Wx on the liquid supply side of the pressure chamber 1. In other words, the width Wx on the liquid supply side of the pressure chamber 1 becomes wide as compared with the width Wy on the liquid discharge side of the pressure chamber 1.

Each of the pressure chambers 1 is formed such that the shape of the cross section along the face perpendicular to the longitudinal direction A2 at the second end 1*b* of the pressure chamber 1 substantially becomes a square.

Even if a displacement amount of the partition 3 serving as the piezoelectric device is the same, a change rate of the cross-section area is larger when the cross-section area of the pressure chamber 1 is smaller. Therefore, the pressurizing efficiency of the ink I to be supplied into the pressure chamber 1 is higher in case of the smaller cross-section area than that in case of the larger cross-section area.

The width W of the pressure chamber 1 becomes narrow as it approaches the nozzle 30*a* as illustrated in FIG. 2. That is, the pressurizing efficiency of the ink I becomes high as it approaches the nozzle 30*a*. Therefore, since the pressurization is performed at the position closer to the meniscus of the ink formed at the nozzle 30*a*, the vibration responsiveness of the meniscus for the displacement of the partition 3 is improved.

In the inkjet head 100 adopting the shear mode method, if a height h of the partition 3 (pressure chamber 1) becomes higher, the displacement amount becomes larger. Therefore, it is preferable that the height h of the partition 3 is higher as much as possible in order to pressurize the ink I inside the pressure chamber 1 more efficiently. Furthermore, since it is preferable to narrow the width W of the pressure chamber 1 as much as possible, it is preferable that a relationship between the height h and the width W satisfies h>>W.

On the other hand, flow channel resistance R of the fluid, which flows at an arbitrary cross section of the pressure chamber 1 toward the liquid discharge direction A1, having viscosity μ is expressed by the following expression (1).

$$R=[8\cdot\mu(W+h)^2]/(W\cdot h)^3 \quad (1)$$

When the ink inside the pressure chamber is made to flow at high speed, the flow channel resistance R has to be reduced. However, in case of the inkjet head adopting the shear mode method, the flow channel cross-section area W·h is small from the viewpoint of the pressurizing efficiency, and it can be understood from the above expression (1) that the flow channel resistance R is large. In addition, when h>>W, the value of (W+h) in the above expression is large as compared with a case of h=W, in case of performing a comparison with the same flow channel cross-section area W·h, and also it can be understood that the flow channel resistance becomes high.

Therefore, in the present embodiment, as illustrated in FIG. 2, the width W of the pressure chamber 1 becomes wide as it approaches the side of the second end 1*b* from the side of the first end 1*a*. Further, the shape of cross section of the pressure chamber 1 substantially becomes a square, that is, the relationship between the height h and the width W approximates to h=W due to expansion of the width W.

Therefore, the flow channel resistance R can be efficiently reduced as it approaches the second end 1*b* of the pressure chamber 1. With that situation, the flow channel resistance can be reduced also as the whole system of the pressure chamber 1. As a result, the flow speed of the ink I inside the pressure chamber 1 is improved.

According to the present embodiment, since the cross-section area of the pressure chamber 1 at the second end 1*b* is larger than that of the pressure chamber 1 at the first end 1*a*, the flow channel resistance when the ink flows into the center of pressure can be reduced. In addition, since the cross-section area of the pressure chamber 1 at the first end 1*a* is smaller than that of the pressure chamber 1 at the second end 1*b*, the pressurizing efficiency of the liquid to the displacement of the partition 3 is improved. That is, the center of pressure of the liquid inside the pressure chamber 1 can be shifted to the side of the nozzle 30*a*, and the distance between the meniscus and the center of pressure can be shortened. Therefore, since the time required to fill the liquid into the pressure chamber 1 can be shortened and the liquid can be pressurized at the position closer to the meniscus, the meniscus can be vibrated at high acceleration. As a result of this, since the ink I discharged from the nozzle 30*a* can be minutely cut, it is possible to discharge minute droplets.

Especially, in the present embodiment, to efficiently apply the pressure to the ink at the first end 1*a* of the pressure chamber 1, the width of the pressure chamber 1 is set to be shorter than the height of the pressure chamber 1, and the width is varied to become long toward the second end 1*b* while fixing the height of the pressure chamber 1 constant. Therefore, in the present embodiment, the meniscus can be effectively vibrated at high acceleration, and it becomes possible to discharge the minute droplets effectively. In addition, since the cross-section shape of the pressure chamber 1 is substantially a square at the second end 1*b*, the flow channel resistance of the ink can further effectively be reduced, and it is thus possible to discharge the minute droplets more effectively.

Figure 4:
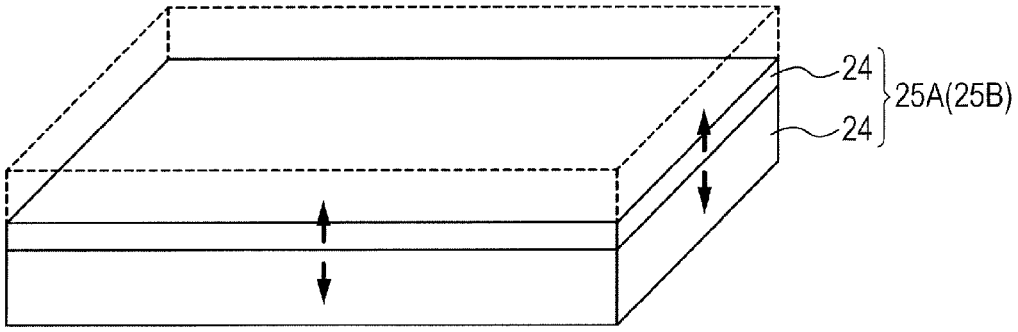
FIG. 4 is a diagram for describing a manufacturing method of the inkjet head.

Next, a manufacturing method of the inkjet head 100 in the present embodiment will be described. First, two polarized piezoelectric plates 24 and 24 are reversed and bonded to each other such that the polarization directions thereof become opposite to each other as illustrated in FIG. 4, thereafter the plates are processed into a desired size by processing such as grinding or the like to provide the piezoelectric plate. As to this piezoelectric plate, two piezoelectric plates are formed, and the one plate is treated as a first piezoelectric plate 25A and the other plate is treated as a second piezoelectric plate 25B.

Figure 5:
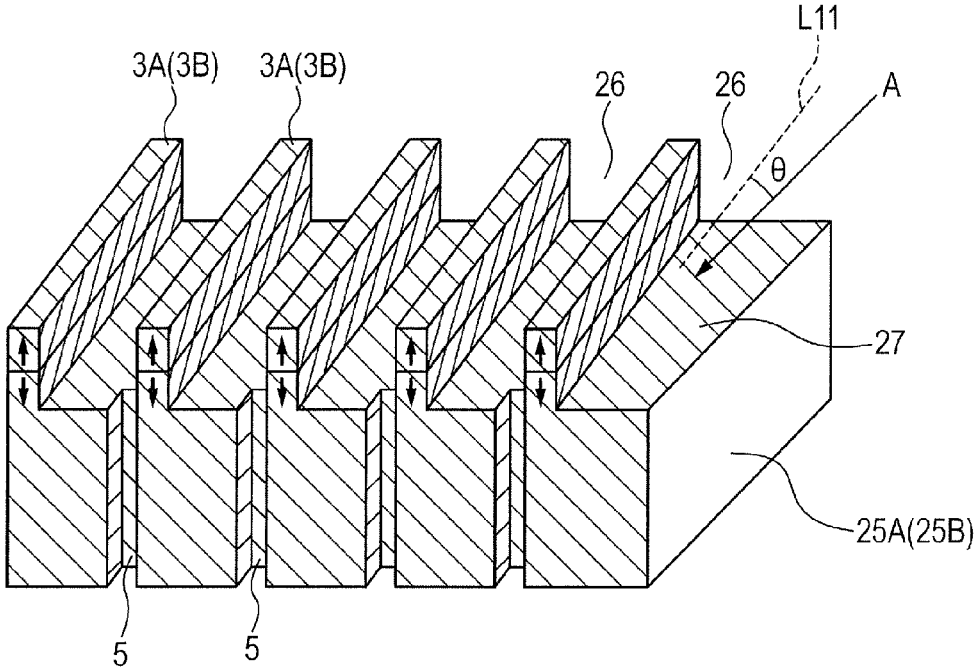
FIG. 5 is a diagram for describing the manufacturing method of the inkjet head.

Subsequently, the plurality of first partitions 3A composed of the piezoelectric material (actuator) are formed on the first piezoelectric plate 25A by processing partition grooves 26 as illustrated in FIG. 5 (first partition forming process). Herewith, the plural first partitions 3A were formed on the one face 11*a* of the first substrate 11. Here, the partition grooves 26 are processed to the direction along a straight line L11 illustrated in FIG. 5 inclined by the predetermined angle θ for a straight line A extending to the liquid discharge direction A1 on the first piezoelectric plate 25A. That is, in the first partition forming process, the first partitions 3A are formed such that the width of the pressure chamber 1 to be formed in a later-described pressure chamber forming process at the second end 1*b* is longer than that at the first end 1*a* to be connected to the nozzle 30*a*.

In addition, the front groove 5 is processed on the piezoelectric plate 25A. As for the processing of these grooves, it is preferable to use, for example, a cutting process by a diamond blade so that a temperature of the piezoelectric plate 25A does not exceed Curie temperature when performing the process.

Figure 6:
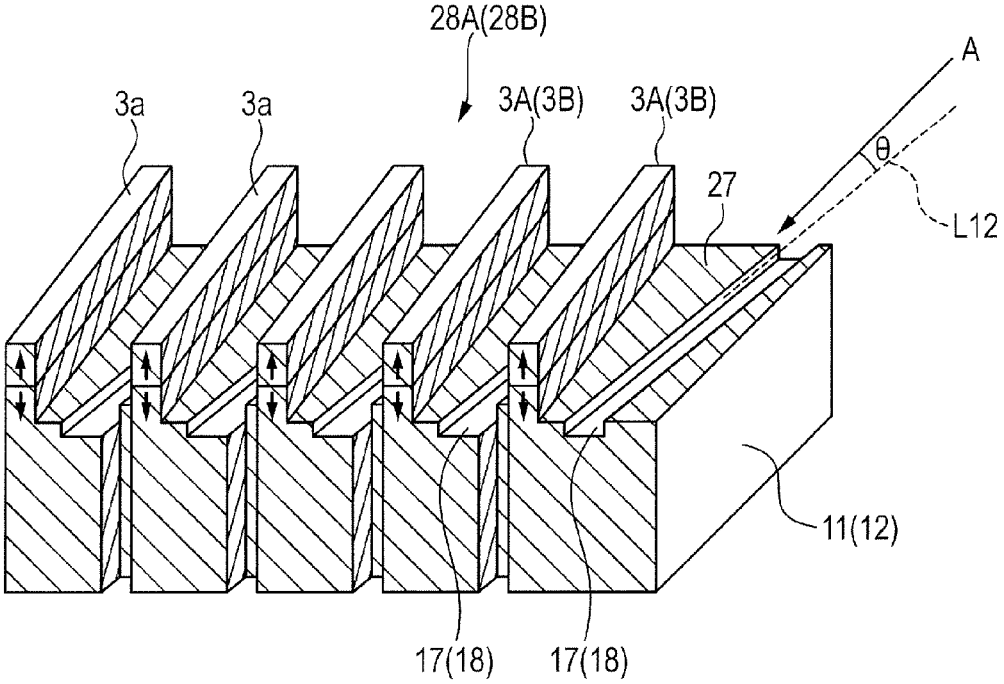
FIG. 6 is a diagram for describing the manufacturing method of the inkjet head.

Next, a conductive layer 27 is applied on the entire surface of the first piezoelectric plate 25A, to which the partition grooves 26 have been processed. This process can be easily realized by electroless plating or the like. Thereafter, as illustrated in FIG. 6, the conductive layer 27 on an upper face (a tip) 3*a* of the partition 3 is selectively eliminated by the grinding or the like, and further, a first groove 17 is processed inside the partition groove 26 such that the conductive layer 27 is divided. That is, in the first piezoelectric plate 25A, the first groove 17, to which the tip 3*a* of the second partition 3B is bonded, is formed on the one face which becomes the first substrate 11 (first groove forming process). In this case, the groove 17 is processed to the direction along a straight line L12 illustrated in FIG. 6 inclined by the predetermined angle θ to the opposite direction, when the partition groove 26 was formed, for the straight line A extending to the liquid discharge direction A1 of the piezoelectric plate 25A.

As for the first groove 17 to be processed, it is preferable that the width thereof is set to become substantially identical with the width of the first partition 3A, and it is preferable that this groove is formed by the cutting process with the diamond blade as above. Thereafter, although it is not illustrated, a protecting insulation film is applied on the entire surface of the formed face of the first partition 3A by a sputtering method or the like.

Accordingly, a first substrate unit 28A, which includes the first substrate 11 and the plural first partitions 3A erectly provided on the first substrate 11, illustrated in FIG. 6 is manufactured.

In the present embodiment, a second substrate unit 28B, which includes the second substrate 12 and the plural second partitions 3B erectly provided on the second substrate 12, is also manufactured by the same manufacturing method as that of the first substrate unit 28A.

That is, the plural second partitions 3B composed of the piezoelectric material (actuator) are formed on the second piezoelectric plate 25B by processing the partition grooves 26 as illustrated in FIG. 5 (second partition forming process). Next, the conductive layer 27 is applied on the entire surface of the second piezoelectric plate 25B, to which the partition grooves 26 were processed. Next, the second groove 18 is processed inside the partition groove 26 such that the conductive layer 27 is divided. That is, in the second piezoelectric plate 25B, the second groove 18, to which the tip 3*a* of the first partition 3A is bonded, is formed on the one face which becomes the second substrate 12 (second groove forming process). As just described, the second substrate unit 28B, of which the constitution is similar to that of the first substrate unit 28A, is manufactured by the same manufacturing method as that of the first substrate unit 28A.

Figure 7:
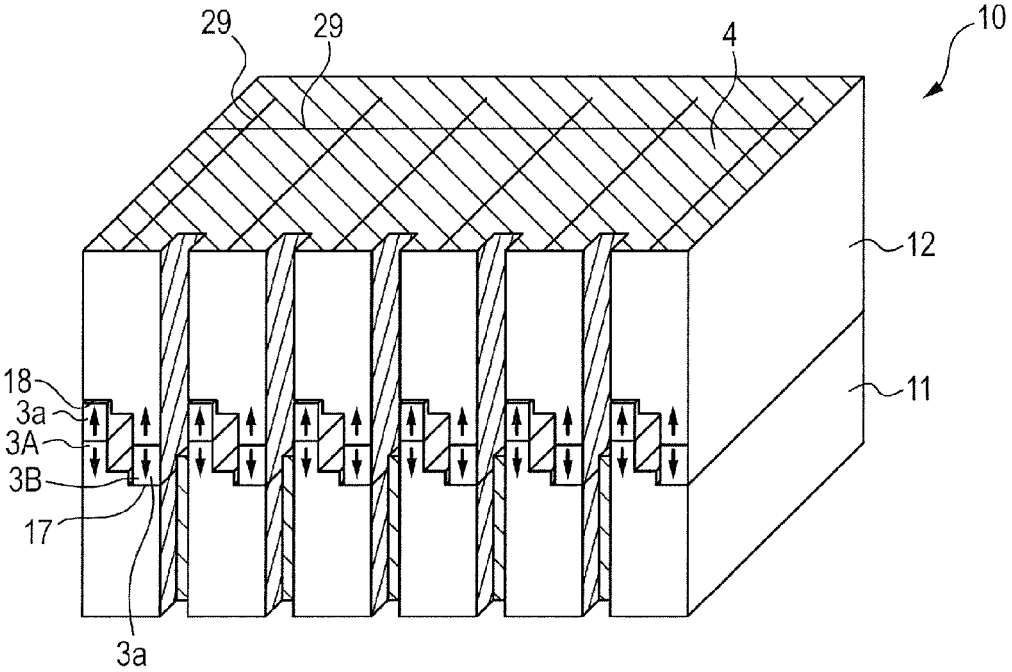
FIG. 7 is a diagram for describing the manufacturing method of the inkjet head.

Subsequently, an adhesive is applied to the tips 3*a* and 3*a* of the partitions 3A and 3B, and the substrates 11 and 12 are faced each other, and then the tip 3*a* of the partition 3A is interdigitated with the groove 18 and the tip 3*a* of the partition 3B is interdigitated with the groove 17 as illustrated in FIG. 7. Thus, the first partitions 3A and the second partitions 3B are alternately provided in parallel in the width direction. Then, the tips 3*a* of the partitions 3A are bonded to the grooves 18 and the tips 3*a* of the partitions 3B are bonded to the grooves 17, thereby obtaining the discharge unit 10. That is, the tips 3*a* of the first partitions 3A are bonded to the one face of the second substrate 12 and the tips 3*a* of the second partitions 3B are bonded to the one face of the first substrate 11, thereby forming the pressure chambers 1 partitioned by the respective partitions 3A and 3B extending toward the longitudinal direction (pressure chamber forming process).

After then, the front and back faces of the discharge unit 10 are grinded and polished to eliminate the conductive layer 27 and adjust to have the desired shape and size. Further, extraction electrode division grooves 29 are processed on the upper face of the discharge unit 10, thereby obtaining individual extraction electrodes 4 electrically divided and separated respectively.

After forming the discharge unit 10 by the above series of processes, the nozzle plate 30, the back plate 40, the manifold 50, the flexible substrates 60 and 60 and the like are combined with others as illustrated in FIG. 1, thereby obtaining the inkjet head 100 according to the present embodiment.

In the present embodiment, the structure of the first substrate unit 28A is identical with the structure of the second substrate unit 28B. That is, as the second substrate unit 28B, the substrate unit having the same structure as that of the first substrate unit 28A rotated by 90 degrees is used. As just described, since it is unnecessary to manufacture the different-structure substrate units in order to manufacture the two substrate units 28A and 28B, the manufacturing process can be simplified and thus manufacturing costs can be reduced.

EXAMPLES

As to the discharge unit 10 described in the above embodiment, it was formed with such the structure, where the partition grooves 26 and the grooves 17 (18) respectively have the predetermined angle θ=0.25°, for the liquid discharge direction A1, by using the piezoelectric ceramics C-6 made by Fuji Ceramics Corporation as the piezoelectric material.

Figure 8:
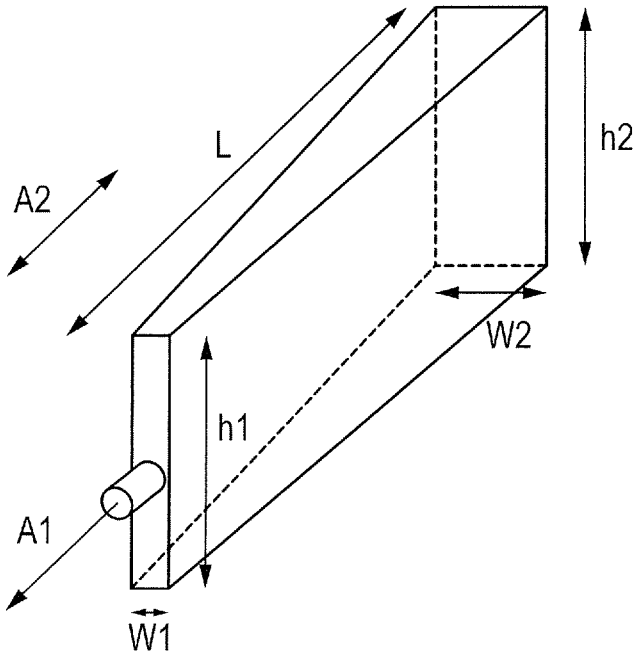
FIG. 8 is a perspective diagram illustrating a pressure chamber of the inkjet head.

FIG. 8 is a structural schematic diagram illustrating the pressure chamber. Related to FIG. 8, the pressure chamber 1 having the length L=7 [mm] in the liquid discharge direction A1, the width W1=30 [μm] of the first end 1*a* on the side of the nozzle 30*a* and the width W2=90 [μm] of the second end 1*b* on the side of the common liquid chamber 53 was obtained. Note that both the height h1 of the first end 1*a* on the side of the nozzle 30*a* and the height h2 of the second end 1*b* on the side of the common liquid chamber 53 were 210 [μm].

Similarly, for the purpose of comparison, the partition groove 26 and the groove 17 were formed along the liquid discharge direction A1, and the discharge unit having the comparative structure set as W1=W2 was also manufactured as a comparative example. As to the discharge units of the comparative examples, the discharge units of which the widths W1 and W2 were respectively 30 [μm] (comparative example 1), 60 [μm] (comparative example 2) and 90 [μm] (comparative example 3) were prepared.

In addition, for the purpose of further comparison, the discharge unit of which the pressure chamber had the constant width W and which had the variable height h was prepared as a comparative example 4. Specifically, in the pressure chamber illustrated in FIG. 8, the width W1 and the width W2 were set to 30 [μm], the height h1 was set to 210 [μm], and the height h2 was set to 630 [μm] by deepening it as advancing to the direction opposite to the liquid discharge direction A1.

Next, the inkjet heads were formed by using the respective prepared discharge units, the target ink discharge amount was set to 1 [pl] or less, and then the discharge performance was evaluated. Note that the diameter of the nozzle was set to 10 [μm] in all the inkjet heads, and the solution of ethylene glycol, of which the concentration was 80 [wt %], was used as the ink to be used for the evaluation.

First, the voltage of 10 [V] was applied to the respective partitions, and the frequency of the meniscus generated in that case was evaluated. Next, the voltage of 15 [V] was applied with the pulse width corresponding to half of the obtained frequency, and the discharge amount of ink to be discharged in that case was evaluated. The results according to the series of these evaluations are indicated in Table 1.

TABLE 1

| | Embodiment | Comparative Example 1 | Comparative Example 2 | Comparative Example 3 | Comparative Example 4 |
|---|---|---|---|---|---|
| Width W1 (height h1) [μm] | 30 (210) | 30 (210) | 60 (210) | 90 (210) | 30 (210) |
| Width W2 (height h2) [μm] | 90 (210) | 30 (210) | 60 (210) | 90 (210) | 30 (630) |
| meniscus frequency [kHz] | 82.5 | 24.8 | 42.5 | 79.5 | 58.0 |
| discharge amount [pl] when applying 15 V | 0.9 | 3.2 | 2.1 | not discharged | not discharged |

In the comparative examples 1 to 3, it was understood that when the width W of the pressure chamber was narrowed, the amplitude of the meniscus became large, on the other hand, the vibration frequency of the meniscus reduced. Consequently, since the vibration frequency of the meniscus was low in the comparative example 1, where the width W of the pressure chamber was narrow, the discharge ink could not be minutely cut and thus the discharge amount became large. Incidentally, to reduce the discharge amount, when the voltage to be applied was reduced, the ink was not discharged, and the ink droplets of 1 [pl] or less could not be obtained.

Also, as to the comparative example 2, although it was observed that the discharge amount was slightly reduced as compared with the comparative example 1, the vibration frequency of the meniscus was low, and the ink droplets of 1 [pl] or less could not be obtained. In the comparative example 3, where the width of the pressure chamber was wide, although the frequency of the meniscus was high, the ink could not be discharged at any voltage conditions.

In the comparative example 4, the ink was not discharged when applying the voltage of 15 [V]. Although it was confirmed that the ink was discharged by increasing the voltage, the discharge amount at that time was 1 [pl] or more, and the ink droplets of 1 [pl] or less could not be obtained.

Whereas, in the present example, the minute ink droplets, of which the amount is 0.9 [pl], could be discharged when applying the voltage of 15 [V]. From the above result, the meniscus could be vibrated at high acceleration and the minute amount of ink could be discharged by the constitution of the inkjet head in this example.

The present invention is not limited to the above embodiment, but many variations and modifications can be adopted by a person skilled in this field within the scope of the technical idea according to the present invention.

In the above embodiment, although the width of the pressure chamber 1 is set to become long continuously toward the second end 1*b* from the first end 1*a*, it may be set to become long stepwise. In addition, a section, where the width of the pressure chamber 1 does not vary, may exist on the way toward the second end 1*b* from the first end 1*a*.

In the above embodiment, although the case that the width of the pressure chamber 1 is relatively shorter than the height of the pressure chamber 1 at the first end 1*a* has been described, a case that the height of the pressure chamber 1 is relatively shorter than the width of the pressure chamber 1 at the first end 1*a* is also acceptable. Also in that case, the height of the pressure chamber 1 is allowed to become high continuously or stepwise as it approaches the second end 1*b*, and a section, where the height does not vary, may exist.

In the above embodiment, the partitions 3A and 3B are respectively provided erectly on the first substrate 11 and the second substrate 12, and the partitions 3A and 3B are alternately arranged. However, it may be constituted that the partitions 3 are erectly provided on any one of the substrates and these partitions are bonded to the other substrate.

In the above embodiment, although the piezoelectric material constituted by bonding the base piezoelectric material, of which the partitions 3 are polarized in the height direction C, to the tip piezoelectric material polarized in the direction opposite to the polarized direction of the base piezoelectric material has been described, it may be constituted by a piezoelectric material polarized only in one direction, i.e., its height direction.

EFFECTS OF INVENTION

According to the present invention, since the cross-section area of the pressure chamber at the second end is larger than the cross-section area of the pressure chamber at the first end, it is possible to reduce the flow channel resistance when the liquid flows into the center of pressure. Moreover, since the cross-section area of the pressure chamber at the first end is smaller than the cross-section area of the pressure chamber at the second end, it is possible to improve the pressurizing efficiency of the liquid to the displacement of the partition. That is, it is possible to shift the center of pressure of the liquid in the pressure chamber to the side of the nozzle, and it is thus possible to reduce the distance between the meniscus and the center of pressure. For this reason, it is possible to shorten the time required to fill the liquid into the pressure chamber and pressurize the liquid at the position closer to the meniscus. Consequently, it is possible to vibrate the meniscus at high acceleration, and it is thus possible to discharge the minute amount of the liquid.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2013-018081, filed Feb. 1, 2013, which is hereby incorporated by reference herein in its entirety.

REFERENCE SIGNS LIST

1 . . . pressure chamber, 1*a* . . . first end, 1*b* . . . second end, 3 . . . partition, 11 . . . first substrate, 12 . . . second substrate, 13 . . . electrode pair, 30 . . . nozzle plate (nozzle member), 30*a* . . . nozzle, 100 . . . inkjet head (liquid discharge apparatus)

The invention claimed is:

1. A liquid discharge apparatus comprising:

a plurality of pressure chambers which are formed by a plurality of partitions, each formed of a piezoelectric material;

a plurality of electrode pairs, each of which is arranged on both sides of each partition and shear-deforms each partition; and a nozzle member which is arranged on a side of a first end of each pressure chamber and on which nozzles connected to each pressure chamber have been formed, wherein each pressure chamber is formed such that a relatively shorter one of a height and a width of the pressure chamber at the first end becomes long as it approaches, from the first end, a second end on the opposite side.

2. The liquid discharge apparatus according to claim 1, wherein, at the first end, the width of the pressure chamber is relatively shorter than the height of the pressure chamber.

3. The liquid discharge apparatus according to claim 1, wherein a cross-section shape of each pressure chamber at the second end is substantially a square.

4. The liquid discharge apparatus according to claim 1, wherein the plurality of partitions include a plurality of first partitions protrusively provided on one face of a first substrate and a plurality of second partitions protrusively provided on one face of a second substrate, and each pressure chamber is formed by bonding a tip of one of the first partitions to the one face of the second substrate and bonding a tip of one of the second partitions to the one face of the first substrate.

5. The liquid discharge apparatus according to claim 4, wherein a first groove with which the tip of the one of the second partitions is interdigitated is formed on the one face of the first substrate, and a second groove with which the tip of the one of the first partitions is interdigitated is formed on the one face of the second substrate.

6. The liquid discharge apparatus according to claim 4, wherein each of the first partitions includes a first base-side piezoelectric material protruding from the one face of the first substrate, integrally formed with the first substrate and polarized in a height direction, and a first tip-side piezoelectric material bonded to the first base-side piezoelectric material and polarized in a direction opposite to the polarization direction of the first base-side piezoelectric material, and each of the second partitions includes a second base-side piezoelectric material protruding from the one face of the second substrate, integrally formed with the second substrate and polarized in the height direction, and a second tip-side piezoelectric material bonded to the second base-side piezoelectric material and polarized in a direction opposite to the polarization direction of the second base-side piezoelectric material.

7. The liquid discharge apparatus according to claim 1, wherein an air chamber which is partitioned by the partitions and is not filled with liquid is formed between two adjacent pressure chambers among the plurality of pressure chambers.

* * * * *